US008123288B2

(12) United States Patent
Murphy et al.

(10) Patent No.: US 8,123,288 B2
(45) Date of Patent: Feb. 28, 2012

(54) LOCKING UNIT FOR ROCKING-RECLINING SEATING UNIT WITH POWER ACTUATOR

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 287 days.

(21) Appl. No.: 12/508,927

(22) Filed: Jul. 24, 2009

(65) Prior Publication Data

US 2011/0018331 A1 Jan. 27, 2011

(51) Int. Cl.
*A47C 1/031* (2006.01)

(52) U.S. Cl. ..... 297/85 R; 297/85 M; 297/DIG. 7

(58) Field of Classification Search ..... 297/85 R, 297/85 M, DIG. 7
See application file for complete search history.

(56) References Cited

U.S. PATENT DOCUMENTS

| | | | | |
|---|---|---|---|---|
| 507,270 | A | 10/1893 | Hirschfeld | |
| 2,526,623 | A | 10/1950 | Maurer | |
| 2,714,922 | A | 8/1955 | McKibban et al. | |
| 3,147,038 | A | 9/1964 | Barabas | |
| 3,163,464 | A | 12/1964 | Martin | |
| 3,279,847 | A | 10/1966 | Re | |
| 3,339,972 | A * | 9/1967 | Fletcher | 297/259.2 |
| 3,352,601 | A | 11/1967 | Izchak | |
| 3,383,135 | A | 5/1968 | Posh | |
| 3,493,264 | A | 2/1970 | Re | |
| 3,622,198 | A | 11/1971 | Re | |
| 3,622,202 | A | 11/1971 | Brown | |
| 3,637,255 | A | 1/1972 | Re | |
| 3,863,980 | A | 2/1975 | Ciner | |

(Continued)

FOREIGN PATENT DOCUMENTS

GB 2 106 777 A 4/1983

OTHER PUBLICATIONS

Lusch Brochure: "Functional Fitting and Tubular steel frames for Relaxing Chairs (11 pages), Functional Fittings for Sofabeds and Beds (10 pages), Bed Fitting (5 pages) and Upholstery joints and accessories for furniture (9 pages)", (available before Apr. 7, 2006).

(Continued)

*Primary Examiner* — David Dunn
*Assistant Examiner* — David E Allred
(74) *Attorney, Agent, or Firm* — Myers Bigel Sibley & Sajovec

(57) ABSTRACT

A rocking and reclining seating unit includes: (a) an upright position, (b) an intermediate TV position, in which an ottoman is generally horizontally disposed in front of a seat and a backrest and the seat substantially maintain the same relationship as in the upright position, and (c) a fully reclined position, in which the angle between the backrest and the seat increases; a reciprocating mechanism configured to enable the seat, the backrest and an associated reclining mechanism to experience a longitudinally-directed reciprocating motion relative to a base unit; and a locking unit that prevents reciprocating of the seating unit while in the TV and fully reclined positions by a locking unit that includes a capture member and a locking link that are configured such that the locking link resides in a corner section of the capture member when the seating unit is in the TV and fully reclined positions.

21 Claims, 8 Drawing Sheets

U.S. PATENT DOCUMENTS

| | | | | | |
|---|---|---|---|---|---|
| 4,307,912 | A | | 12/1981 | Watt et al. | |
| 4,386,803 | A | | 6/1983 | Gilderbloom | |
| 4,437,701 | A | * | 3/1984 | Mizelle | 297/85 L |
| 4,519,647 | A | | 5/1985 | Rogers | |
| 4,544,201 | A | * | 10/1985 | Rogers, Jr. | 297/259.2 |
| 4,674,794 | A | | 6/1987 | Pine | |
| 4,681,365 | A | | 7/1987 | Pine | |
| 4,682,815 | A | | 7/1987 | Steifensand | |
| 4,691,964 | A | | 9/1987 | Morgan | |
| 4,696,512 | A | | 9/1987 | Burnett et al. | |
| 4,707,025 | A | | 11/1987 | Rogers, Jr. | |
| 4,722,566 | A | | 2/1988 | Castellini | |
| 4,813,743 | A | | 3/1989 | Mizelle | |
| 4,915,444 | A | | 4/1990 | Rogers, Jr. | |
| 5,007,679 | A | | 4/1991 | Mizelle | |
| 5,086,769 | A | | 2/1992 | Vianello et al. | |
| 5,294,177 | A | | 3/1994 | Rasnick et al. | |
| 5,368,366 | A | * | 11/1994 | Mizelle | 297/423.3 |
| 5,478,133 | A | * | 12/1995 | Tidwell, Jr. | 297/85 R |
| 5,564,781 | A | | 10/1996 | Pine | |
| 5,588,710 | A | * | 12/1996 | Wiecek | 297/463.1 |
| 5,775,775 | A | | 7/1998 | Hoffman | |
| 5,876,094 | A | | 3/1999 | Hoffman | |
| 5,884,970 | A | | 3/1999 | Howard | |
| 5,931,535 | A | | 8/1999 | Sweet | |
| 5,954,392 | A | | 9/1999 | Liss et al. | |
| 6,000,754 | A | | 12/1999 | Lawson | |
| 6,135,559 | A | | 10/2000 | Kowaiski | |
| 6,231,120 | B1 | | 5/2001 | Wiecek | |
| 6,491,342 | B1 | | 12/2002 | Smith | |
| 6,540,291 | B2 | | 4/2003 | Hoffman et al. | |
| 6,612,650 | B1 | | 9/2003 | Ambrosio et al. | |
| 6,634,706 | B2 | | 10/2003 | May | |
| 6,733,071 | B2 | | 5/2004 | Guillot | |
| 6,945,599 | B2 | | 9/2005 | May | |
| 6,948,777 | B2 | | 9/2005 | Marshall et al. | |
| 7,021,711 | B1 | | 4/2006 | Hoffman et al. | |
| 7,040,692 | B1 | | 5/2006 | Pine | |
| 7,083,235 | B2 | | 8/2006 | Grimm et al. | |
| 7,188,904 | B2 | | 3/2007 | Bruck et al. | |
| 7,293,834 | B2 | | 11/2007 | Riach et al. | |
| 7,311,359 | B2 | | 12/2007 | Smith | |
| 7,357,450 | B2 | * | 4/2008 | Rogers | 297/68 |
| 7,497,512 | B2 | * | 3/2009 | White et al. | 297/85 R |
| 8,016,348 | B2 | * | 9/2011 | Hoffman et al. | 297/85 M |
| 2002/0149238 | A1 | * | 10/2002 | Hoffman et al. | 297/85 |
| 2004/0012231 | A1 | * | 1/2004 | Hesse | 297/85 |
| 2006/0082195 | A1 | | 4/2006 | Jiang | |
| 2006/0290174 | A1 | * | 12/2006 | Hoffman et al. | 297/84 |
| 2009/0072593 | A1 | * | 3/2009 | Hoffman et al. | 297/61 |
| 2010/0127555 | A1 | * | 5/2010 | Hoffman et al. | 297/85 M |

OTHER PUBLICATIONS

"Stawett Functional Bed Mechanisms Brochure", pp. 3-93 (2001).

* cited by examiner

LOCKING UNIT FOR ROCKING-RECLINING SEATING UNIT WITH POWER ACTUATOR

FIELD OF THE INVENTION

This invention relates generally to seating units, and relates more particularly to reclining seating units with rocking capability.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular reclining chair is the so-called "rocker-recliner," which can, when in the upright position, rock with a forward and rearward motion similar to that of a traditional rocking chair. A typical rocker recliner, one of which is illustrated in U.S. Pat. No. 4,519,647 to Rogers, includes an arcuate rocker cam that is attached with the lower portion of each mechanism, with the lower convex surface of the rocker cam contacting a level bearing surface of the base. Also, a spring assembly is mounted to the base of the chair and to each rocker cam. Each spring assembly includes two quite stiff, vertically-oriented helical springs attached to mounting brackets that are in turn fixed to the base and to the rocker cam. When the chair is in its upright position and is unoccupied, the seat, backrest and reclining mechanisms reside above the base, the rocker springs are deflected only along their longitudinal axes, and the rocker cams rest on a level portion of the base. When an occupant sits on the chair and applies a forwardly- or rearwardly-directed force to the seat or backrest, the seat and backrest move relative to the base. The path of movement is defined by the convex shape of the rocker cams as they rock on the level bearing surface of the base, with the result that the seat and backrest simulate the rocking motion of a rocking chair. During the rocking movement, the rocker springs deflect such that their top portions bend away from their longitudinal axes as the chair rocks forward and back. The deflection in the springs urges the springs (and, in turn, the seat and backrest) to return to their original positions as the chair returns to and through the upright position. In this manner, the chair is capable of providing a controlled rocking motion when in the upright position.

Many, if not all, chairs of this design include some type of safety feature, such as an extendable foot, that prevents rocking when the chair is in a reclined position. For example, U.S. Pat. No. 6,000,754 to Lawson discloses a rocker lock that is pivotally interconnected with the rear portion of the reclining mechanism and with the base of the chair. More specifically, the rocker lock includes three separate pivotally interconnected links mounted to the base and to the reclining mechanism. A bracket is mounted to and extends above the base. A slotted link is pivotally and slidably attached to the bracket via a pin on the bracket. A support link, to which a roller is attached, is pivotally interconnected with the forward end of the slotted link and with the reclining mechanism. A control link is pivotally interconnected with the support link and to the reclining mechanism. In the upright position, as the chair rocks, the slotted link moves forwardly and rearwardly relative to the mounting bracket, as the pin on the mounting bracket is free to slide within the slot of the slotted link as it moves. As the chair moves to an intermediate reclined position (often termed the "TV position"), movement of the reclining mechanism causes the control link to drive the roller on the support link downwardly into contact with a plate attached to the base. The slotted link is forced rearwardly so that the pin of the mounting bracket is lodged against the front edge of the slot. This placement of the wheel and the pin in the slot prevents the chair from rocking.

This locking mechanism can have some shortcomings. Because the slotted link slides on the pin of the mounting bracket during the rocking motion, in some instances the occupant of the chair can rock forward sufficiently that the rear end of the slot strikes the pin, thereby giving a jolt to the occupant. Also, because of the configuration of the locking mechanism, if the occupant is rocking forward when releasing the chair to a reclined position, in some instances the chair can "catch" and impede reclining movement. One locking mechanism that proposes to overcome some of these shortcomings is discussed in U.S. patent application Ser. No. 10/982,108, filed Nov. 4, 2004 and entitled Rocking-Reclining Seating Unit with Motion Lock, the disclosure of which is hereby incorporated herein in its entirety. Nevertheless, it may be desirable to provide additional configurations for motion locking mechanisms that can remove cost and/or labor from the manufacturing process and that can improve performance.

SUMMARY OF THE INVENTION

As a first aspect, embodiments of the present invention are direction to a rocking and reclining seating unit. The seating unit comprises: a base unit; a generally horizontally-disposed seat positioned above the base unit; a generally upright backrest positioned above the base unit and substantially rearward of the seat; an extendable ottoman; a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; a longitudinally-directed reciprocating mechanism attached with the base unit and the reclining mechanism, the reciprocating mechanism configured to enable the seat, backrest and reclining mechanism to experience a longitudinally-directed reciprocating motion relative to the base unit; and a locking unit coupled to the reclining mechanism that allows the seating unit to reciprocate while in the upright position but prevents reciprocating of the seating unit while in the TV and fully reclined positions. The locking unit comprises: a locking link pivotally attached with the reclining mechanism; and a capture member fixed to the base, the capture member having a corner section. The capture member and the locking link are configured such that the locking link resides in the corner section of the capture member when the seating unit is in the TV and fully reclined positions. This configuration provides a relatively simple and straightforward locking system for the seating unit.

As a second aspect, embodiments of the present invention are directed to a rocking and reclining seating unit, comprising: a base unit; a generally horizontally-disposed seat positioned above the base unit; a generally upright backrest positioned above the base unit and substantially rearward of the seat; an extendable ottoman; a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; a power actuating unit attached to the reclining mechanism; a rocker mechanism attached with the base unit and the reclining mechanism, the rocker mechanism configured to enable the seat, backrest and reclining mechanism to experience a longitudinally-directed rocking motion relative to the base unit; and a locking unit coupled to the reclining mechanism that allows the seating unit to rock while in the upright position but prevents rocking of the seating unit while in the TV and fully reclined positions. The locking unit comprises: a locking link pivotally attached with the reclining mechanism; and a capture member fixed to the base, the capture member having a corner section. The capture member and the locking link are configured such that the locking link resides in the corner section of the capture member when the seating unit is in the TV and fully reclined positions.

As a third aspect, embodiments of the present invention are directed to a rocking and reclining seating unit, comprising: a base unit; a generally horizontally-disposed seat positioned above the base unit; a generally upright backrest positioned above the base unit and substantially rearward of the seat; an extendable ottoman; a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases; a longitudinally-directed reciprocating mechanism attached with the base unit and the reclining mechanism, the reciprocating mechanism configured to enable the seat, backrest and reclining mechanism to experience a longitudinally-directed reciprocating motion relative to the base unit; and a locking unit coupled to the reclining mechanism that allows the seating unit to reciprocate while in the upright position but prevents reciprocating of the seating unit while in the TV and fully reclined positions. The locking unit comprises: a locking link pivotally attached with the reclining mechanism; and a capture member fixed to the base. The locking link engages both the base and the capture member when the seating unit is in the TV and fully reclined positions.

DETAILED DESCRIPTION OF EMBODIMENTS OF THE INVENTION

Figure 1:
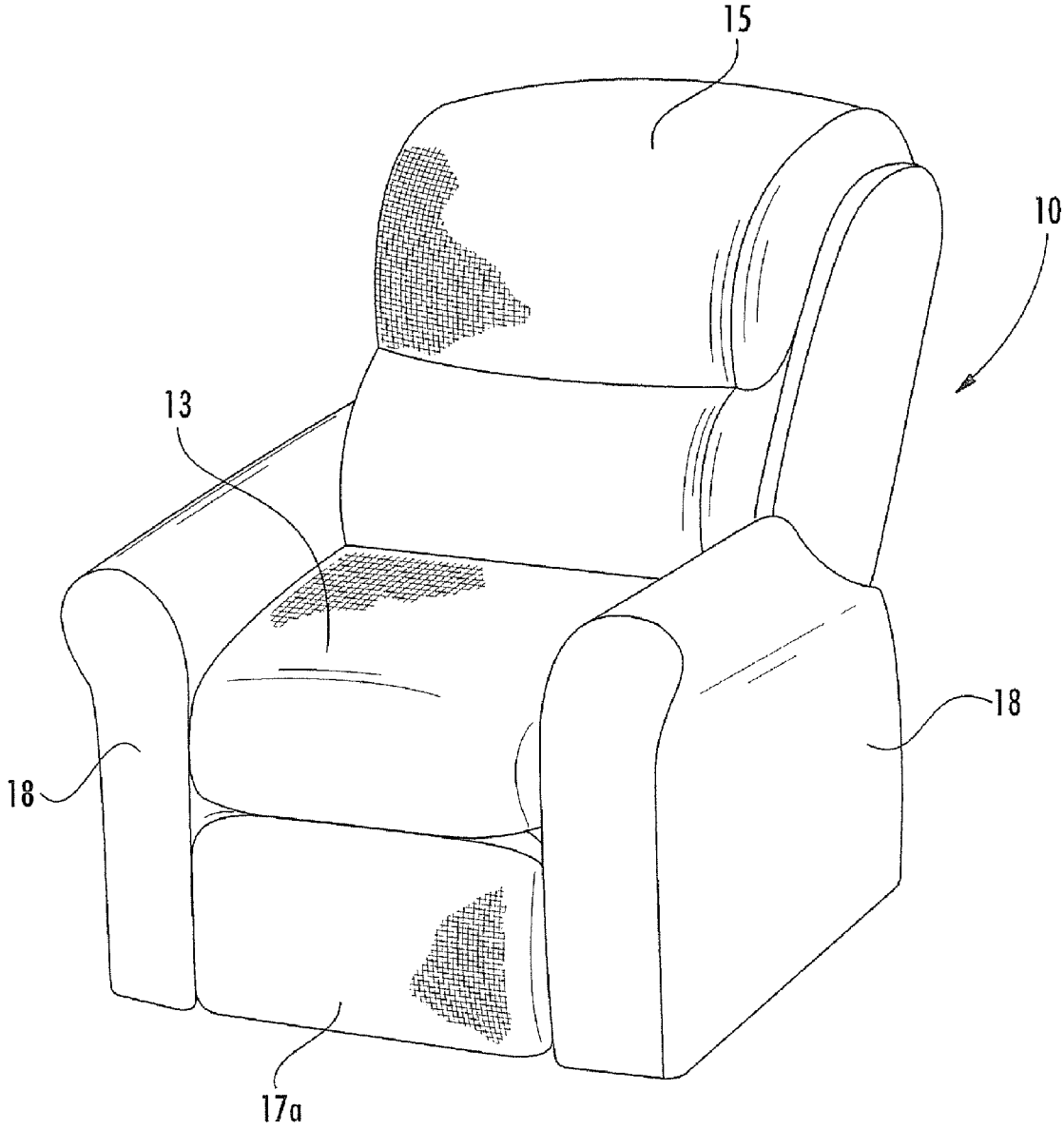
FIG. 1 is a perspective view of a rocker-recliner chair according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a swiveling rocker-recliner chair, designated broadly at 10, is illustrated in FIGS. 1-5. The chair 10 includes a base unit 11, a seat 13 that is generally horizontally disposed above the base unit 11, a backrest 15 that is generally vertically and disposed substantially above a rear portion of the seat 13, and two ottomans 17*a*, 17*b*, which, in the upright position of FIG. 1, are generally vertically disposed below a front portion of the seat 13. Arms 18 are positioned on either side of the seat 13 and move in concert with the seat 13.

A pair of mirror image reclining mechanisms 30 (only one of which is shown herein in FIGS. 2-4) are attached to the backrest 15, the seat 13, and the ottomans 17*a*, 17*b*. The reclining mechanisms 30, which comprise a plurality of interconnected links, move the chair 10 between (a) an upright position (FIGS. 1, 2 and 2A), in which the seat 13 is generally horizontally disposed, the backrest 15 is generally vertically disposed, and the ottomans 17*a*, 17*b* are generally vertically disposed and positioned below the seat 13, (b) an intermediate TV position (FIGS. 3 and 3A), in which the ottomans 17*a*, 17*b* are generally horizontally disposed in front of the seat 13 and the backrest 15 and the seat 13 substantially maintain the same relationship as they have in the upright position, and (c) a fully reclined position (FIGS. 4 and 4A), in which the angle between the backrest 15 and the seat 13 increases. These components are described in greater detail below.

Figure 4:
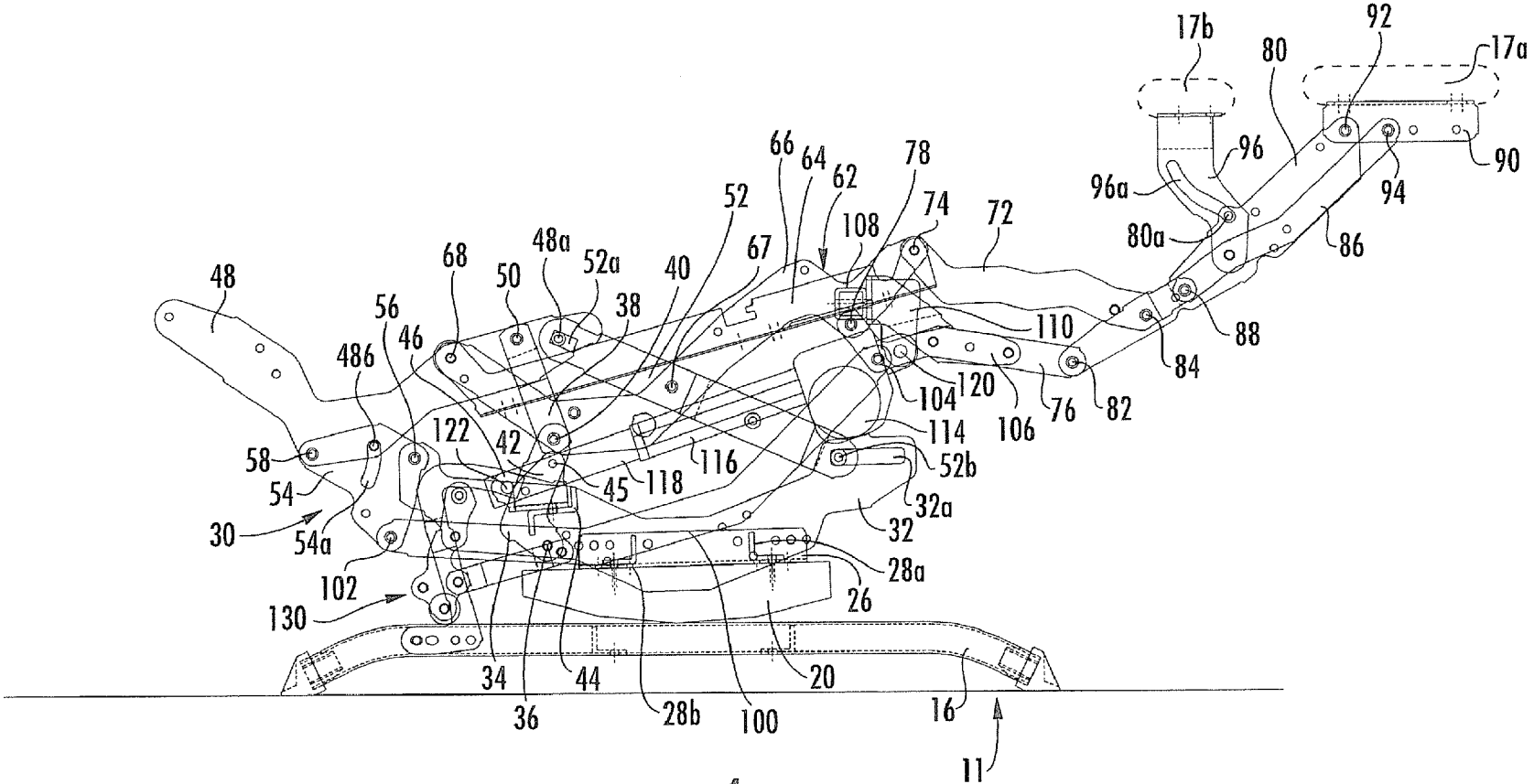
FIG. 4 is a side section view of the chair of FIG. 1 with the chair in its fully reclined position.
Figure 5:
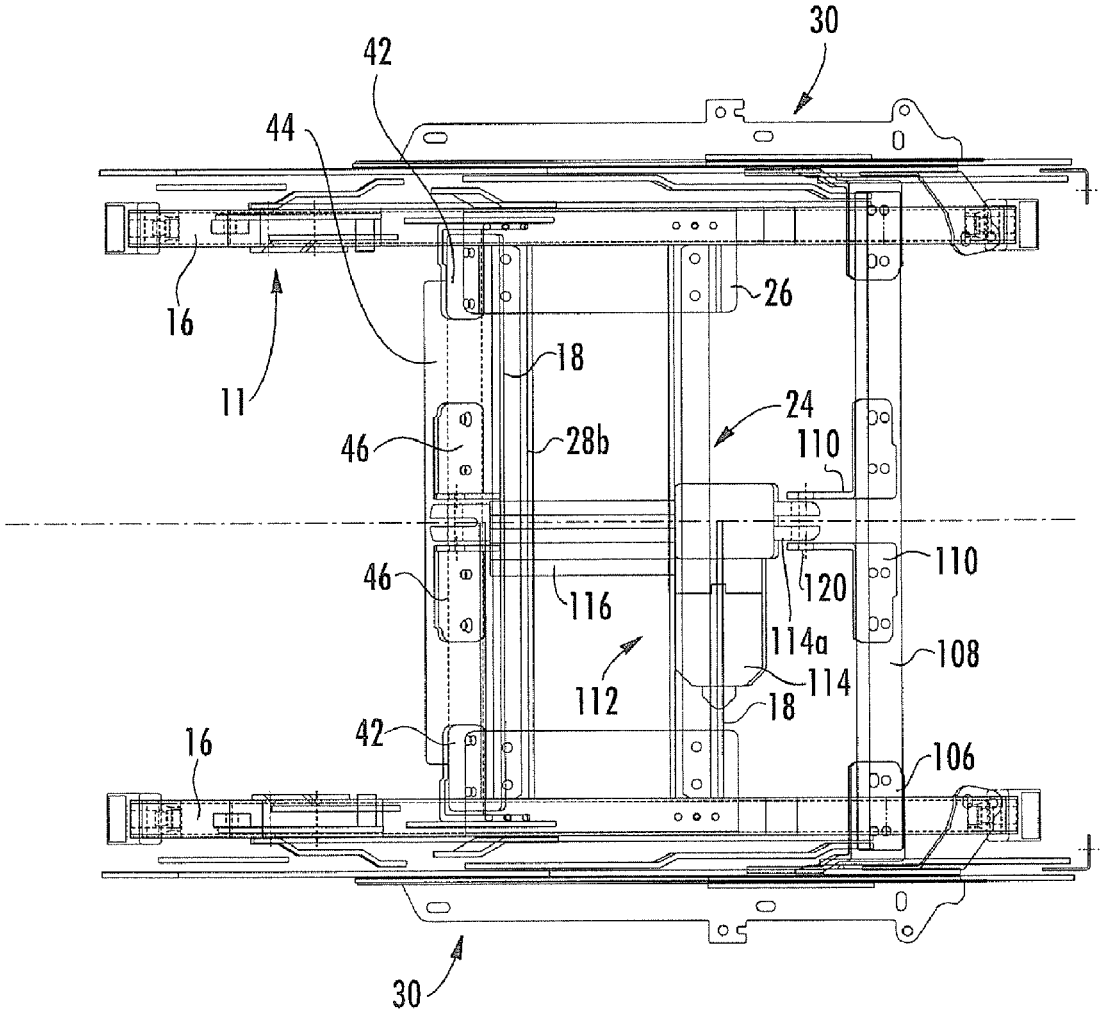
FIG. 5 is a top cutaway view of the frame of the chair of FIG. 1.

Referring to FIGS. 4 and 5. The base unit 11 includes rocker rails 16 that are reinforced by cross-members 18. Rocker cams 20 rest on the upper bearing surfaces of the legs of the rails 16. A recliner foundation 24 is mounted to the top surfaces of the rocker cams 20; the foundation 24 includes longitudinal brackets 26 and cross-members 28*a*, 28*b* that span the longitudinal brackets 26. The arcuate lower surfaces of the cams 20 are configured for rolling contact with the bearing surfaces and enable the chair 10 to have a fore-to-aft rocking motion. This motion is controlled by rocker spring assemblies (not shown) that are attached to the cross-members 18 and to the cross-members 28*a*, 28*b*. The rocker cams 20, the rocker spring assemblies, and the components to which they are attached form a rocker mechanism. It is to be understood other rocker mechanisms may be employed; for example, the rocker spring assemblies may also be attached directly to the reclining mechanisms 30 in other embodiments, such as in the manner illustrated in U.S. Pat. No. 5,876,094 to Hoffman, and the reclining mechanism can be mounted directly onto the rocker cams 20 as illustrated in the U.S. Pat. No. 6,000,754 to Lawson.

Because the reclining mechanisms 30 are mirror images of each other, only one reclining mechanism will be described in detail herein, with the understanding that the discussion is equally applicable to the mirror image mechanism 30. Also, for clarity the mechanism will be described first with reference to FIG. 4 (with the mechanism 30 in its reclined position), then will be described in its upright and TV positions.

Turning now to FIG. 4, the reclining mechanism 30 includes a generally crescent-shaped mounting bracket 32 that is fixed to the longitudinal rail 26. A slot 32*a* is present at the front end of the mounting bracket 30. An L-shaped lower swing link 34 is attached to a lower region of the mounting bracket 32 at a pivot 36 and extends upwardly and rearwardly, then upwardly and forwardly therefrom. A straight upper swing link 38 is attached at its lower end to the upper end of the lower swing link 34 at a pivot 40 and extends upwardly and rearwardly therefrom.

A backpost 48 is fixed to the backrest 15 via a spacer 60 and extends generally forwardly from the lower front end of the backrest 15. The upper swing link 38 is attached to a forward portion of the backpost 48 at a pivot 50. A straight coupling link 52 having a slot 52*a* is attached to the backpost 48 via a pin 48*a* located forwardly of the pivot 50. The coupling link 52 extends forwardly and downwardly from the pin 48*a* to attach to the front end of the mounting bracket 32 via a pin 52*b* inserted into a slot 32*a* in the mounting bracket 32. A trapezoidal sequencer plate 54 is attached to the backpost 48 at a pivot 58, and also interacts with the backpost 48 via a slot 54*a* that receives a pin 48*b*. The sequencer plate 54 is also attached to the rear end of the mounting bracket 32 at a pivot 56.

Still referring to FIG. 4, a seat frame 62, to which the arms 18 are mounted, underlies the seat 13. A seat bracket 64 is fixed to the seat frame 62. In turn, a seat adapter 66 is fixed to the seat bracket 64. The seat adapter 66 is attached to the backpost 48 at a pivot 68 that is located just rearward of the pivot 50. The coupling link 52 is also attached to the seat adapter 66 at a pivot 67. An upper ottoman swing link 72 is attached to a front region of the seat adapter 66 at a pivot 74 and extends downwardly and forwardly therefrom. A tripartite lower ottoman swing link 76 is attached to a pivot 78 that is located rearwardly and downwardly from the pivot 74; the lower ottoman swing link 76 extends generally forwardly from the pivot 78. An upper ottoman extension link 80 is attached to the forward end of the lower ottoman swing link 76 at a pivot 82 and extends forwardly and upwardly therefrom. Also the upper ottoman extension link 80 is attached to the upper ottoman swing link at a pivot 84. A lower ottoman extension link 86 is attached to the forward end of the upper ottoman swing link at a pivot 88 that is positioned above and forward of the pivot 84 and extends upwardly and forwardly therefrom generally parallel with the upper ottoman extension link. An outer ottoman bracket 90 is generally horizontally disposed and is attached to the upper and lower ottoman extension links 80, 86 at pivots 92, 94 respectively. The ottoman 17*a* is mounted on the outer ottoman bracket 90.

A bi-angled inner ottoman bracket 96 is attached at its lower, forward end to the lower ottoman extension link 86 at a pivot 98. At its opposite end, the inner ottoman bracket 96 supports the ottoman 17*b*. The inner ottoman bracket 96 also includes a slot 96*a* that receives a pin 80*a* located on the upper ottoman extension link 80.

A connecting link 100 is attached to the sequencer plate 54 at a pivot 102. The connecting link 100 extends forwardly and slightly upwardly from the pivot 102 to a pivot 104 with the lower ottoman swing link 76.

A locking unit 130 (FIG. 4A) is attached to the reclining mechanism 30 to prevent rocking of the chair 10 when it is in the TV or fully reclined positions. The locking unit 130 includes a lock drive link 132 that is pivotally interconnected at one end to the connecting link 100 at a pivot 134. The drive link 132 is a straight link that extends rearwardly from the pivot 134. The opposite end of the drive link 132 is pivotally interconnected with a locking link 136. The locking link 136 includes a wheel 138 or other engagement structure at its lower (or engagement) end, and further includes a pin 139 at its upper end and a pin 136*a* near the wheel 138. The locking link 136 is also attached to the mounting bracket 32 at a pivot 140. A Z-shaped capture member 200 is fixed to the rail 16. An upright segment 202 extends upwardly from the rail 16, and a horizontal segment 204 extends forwardly from the upright segment 202, thereby forming a corner section 206.

Referring back to FIG. 4 and also to FIG. 5, the chair 10 includes a power unit 112 that drives the chair 10 between its upright, TV and fully reclined positions. The power unit 112 includes a motor unit 114, to which is attached a sleeve 116. The sleeve 116 extends rearwardly from the motor unit 114 and receives a retractable rod 118. The motor unit 114 is electrically connected with an actuator (not shown), such as a toggle switch or the like, that energizes the motor unit 114 upon actuation.

The motor unit 114 is attached to a mounting bracket 110 at a pivot 120 via a mounting tab 114*a* (see FIG. 5). The mounting bracket 110 is then attached to a cross-member 108 that extends between the reclining mechanisms 30. A bracket 106 is fixed to each of the lower ottoman swing links 76 and to the cross-member 108.

The rod 118 of the power unit 112 is attached to a bracket 46 (FIG. 5) at a pivot 122. The bracket 46 is then attached to a Z-shaped cross-member 44 that extends between the reclining mechanisms 30. The cross-member 44 is fixed to a bracket 42 that is in turn pivotally attached to the lower swing link 34 of each reclining mechanism 30 at a pivot 45.

Figure 2:
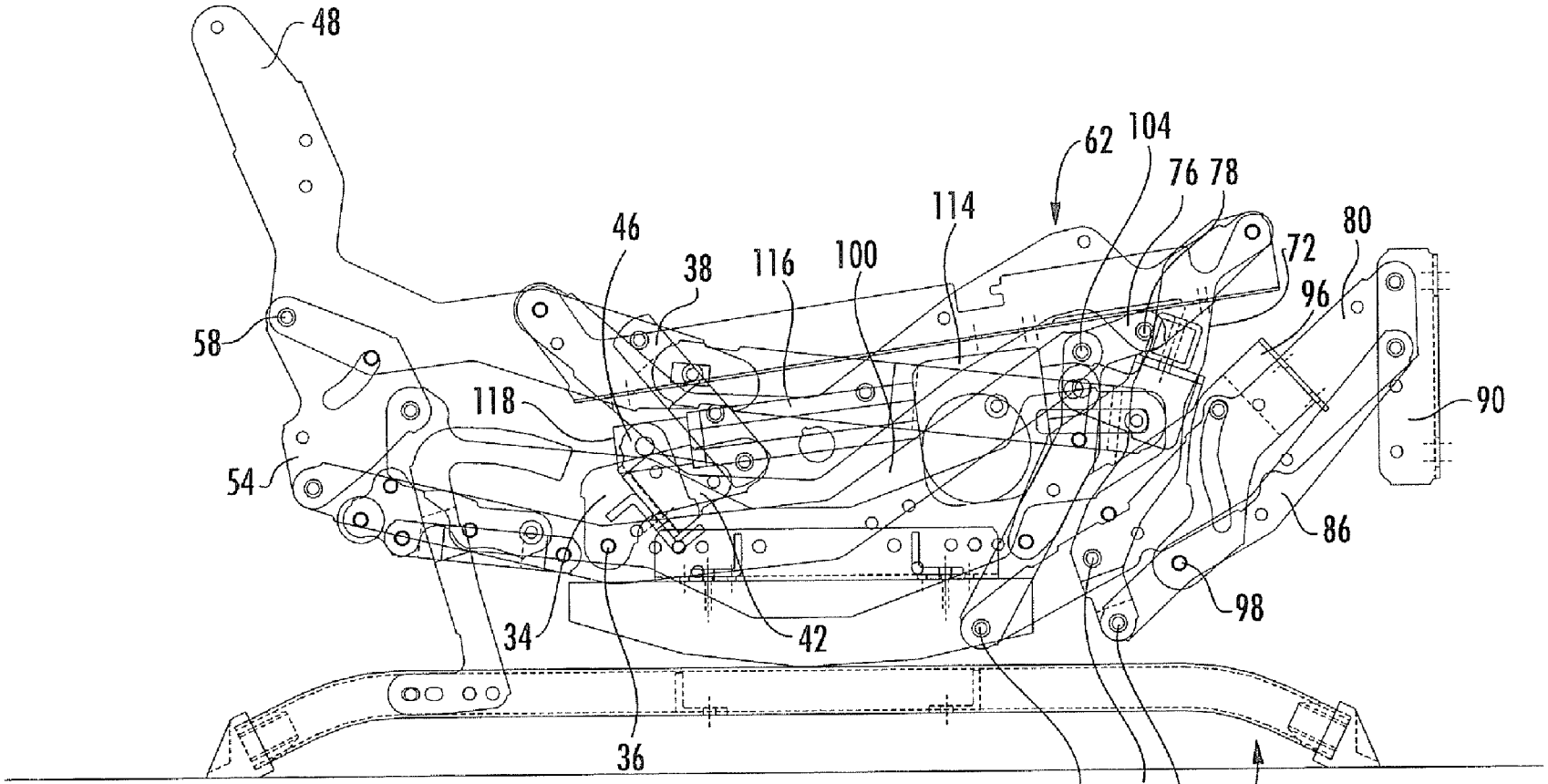
FIG. 2 is a side section view of the chair of FIG. 1 with the chair in its fully upright position.

As can be seen in FIG. 2, in the upright position, the rod 118 of the power unit 112 is retracted into the sleeve 116. As a result, a pantographic linkage formed by the upper and lower ottoman swing links 72, 76 and the upper and lower ottoman extension links 80, 86 are folded under the seat frame 62, which positions the ottoman 17*b* underneath a forward portion of the seat frame 62 and the ottoman 17*a* just forward of and below the seat frame 62 in a vertical orientation. Also, the lower and upper swing links 34, 38 are oriented such that the upper segment of the lower swing link 34 is generally horizontal, which positions the backpost 48 and, in turn, the backrest 15, in a generally upright position.

Figure 2A:
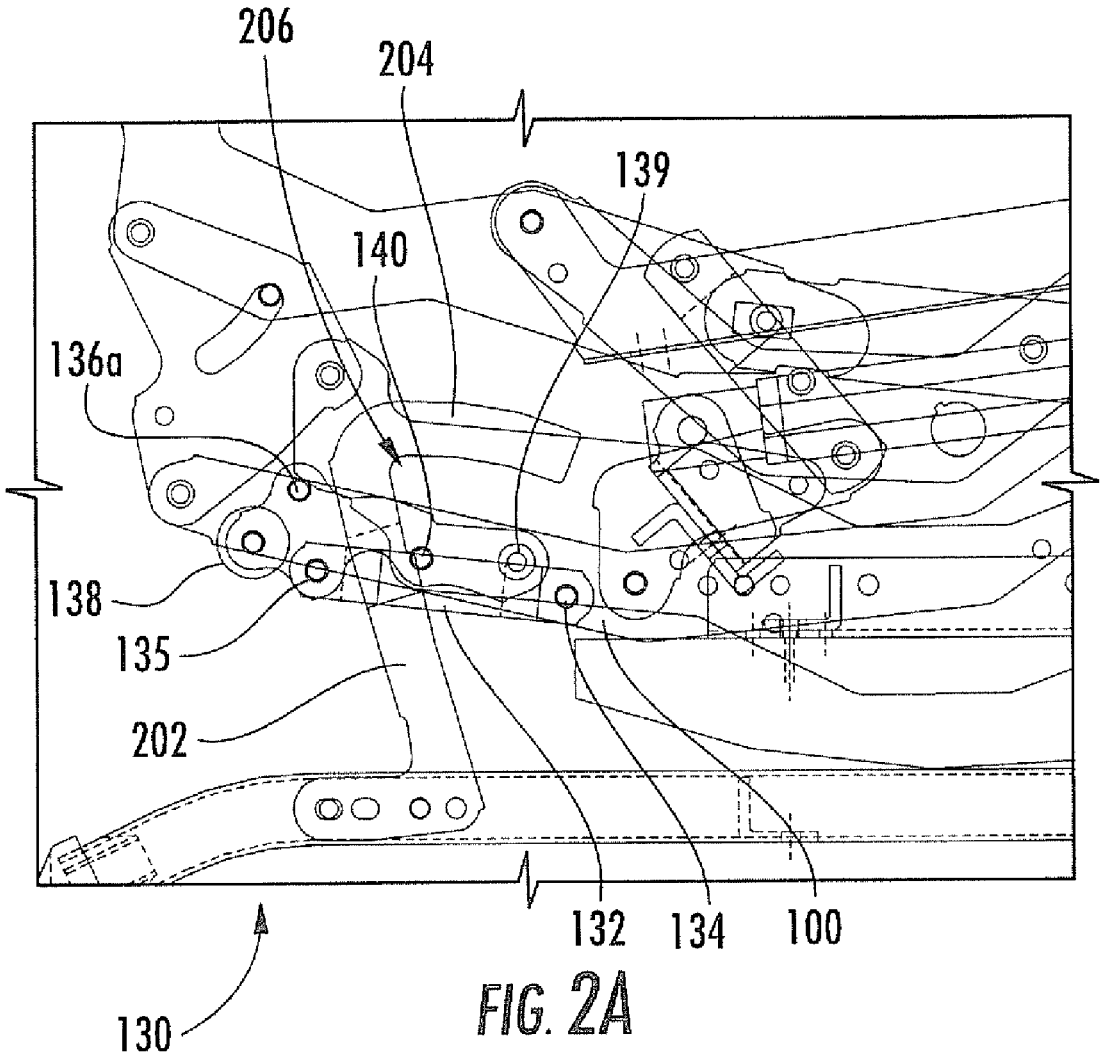
FIG. 2A is an enlarged view of the locking mechanism of the chair of FIG. 1 with the chair in its fully upright position.

Additionally, as shown in FIG. 2A the locking link 136 is generally horizontally oriented, such that the pin 139 is below and forward of the corner section 206 of the capture member 200, and the wheel 139 is positioned well above the rail 16. In this position, the chair 10 is free to rock as the rocker cams 20 engage in rolling motion relative to the rocker rails 16. During the rocking motion, the locking unit 130 is stationary relative to the reclining mechanisms 30.

Figure 3:
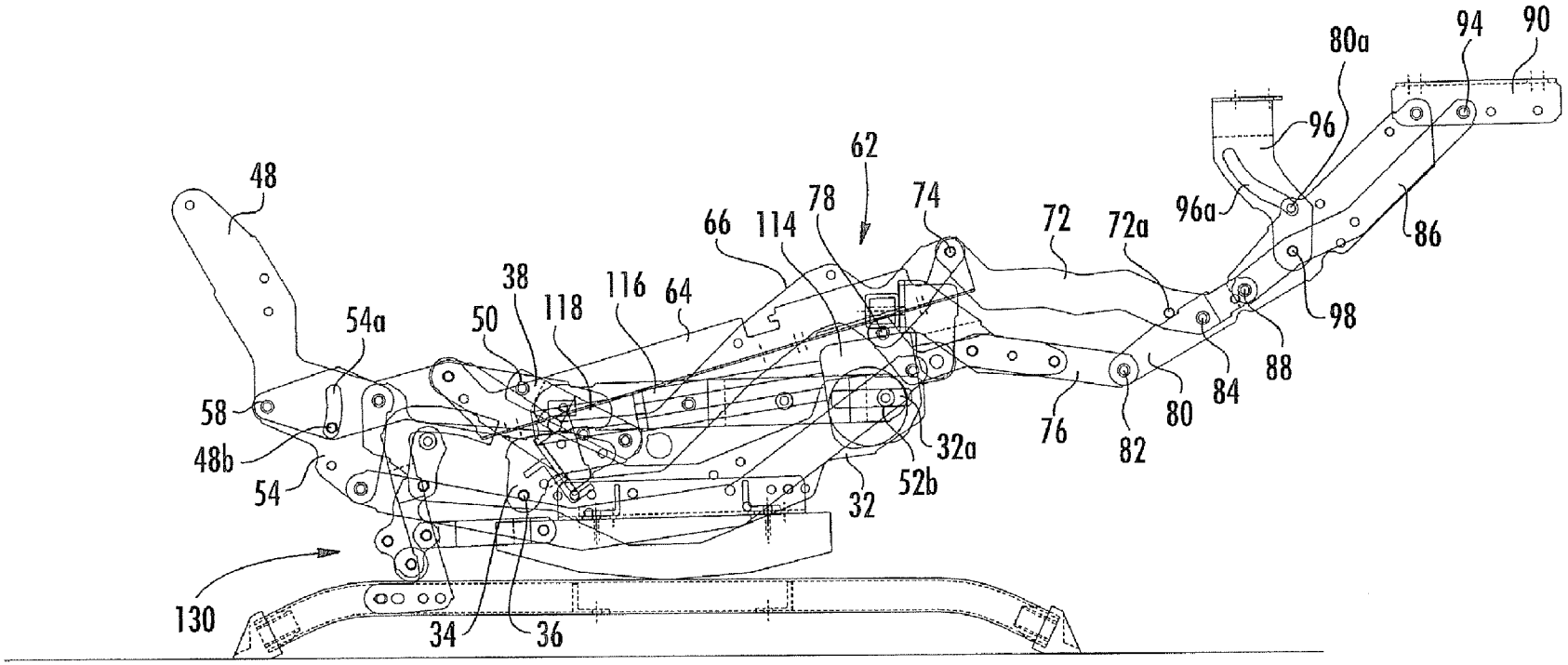
FIG. 3 is a side section view of the chair of FIG. 1 with the chair in its TV position.

To move the chair 10 from the upright position to the TV position of FIG. 3, an occupant of the chair 10 actuates the actuator, which causes the rod 118 to begin to extend from the sleeve 116. Extension of the rod 118 attempts to force the bracket 46 rearwardly, which would also attempt to rotate the bracket 42 and the lower swing link 34 about the pivot 36. However, the weight of the seated occupant prevents substantial rotation of the bracket 42. Because there is little to no fore-and-aft movement of the rear end of the rod 118, the motor unit 114 moves forwardly relative to the base unit 11, thereby driving the lower ottoman swing link 76 counterclockwise about the pivot 78. Rotation of the lower ottoman swing link 76 forces the upper ottoman extension link 80 forward, which in turn draws the upper ottoman swing link 72 counterclockwise around the pivot 74. Also, the lower ottoman extension link 86 moves forwardly more than the upper ottoman extension link 80, such that the outer ottoman bracket 90 and the inner ottoman bracket 96 rotate counterclockwise (rotation of the inner ottoman bracket 96 causes the pin 80*a* to move in the slot 96*a* toward the pivot 98. The rotation of the outer and inner ottoman brackets 90, 96 induces the ottomans 17*a*, 17*b* to rotate from a vertical orientation to a horizontal orientation. Motion of the ottomans 17*a*, 17*b* ceases when a pin 72*a* on the upper ottoman swing link 72 strikes the upper edge of the lower ottoman extension link 80.

Figure 3A:
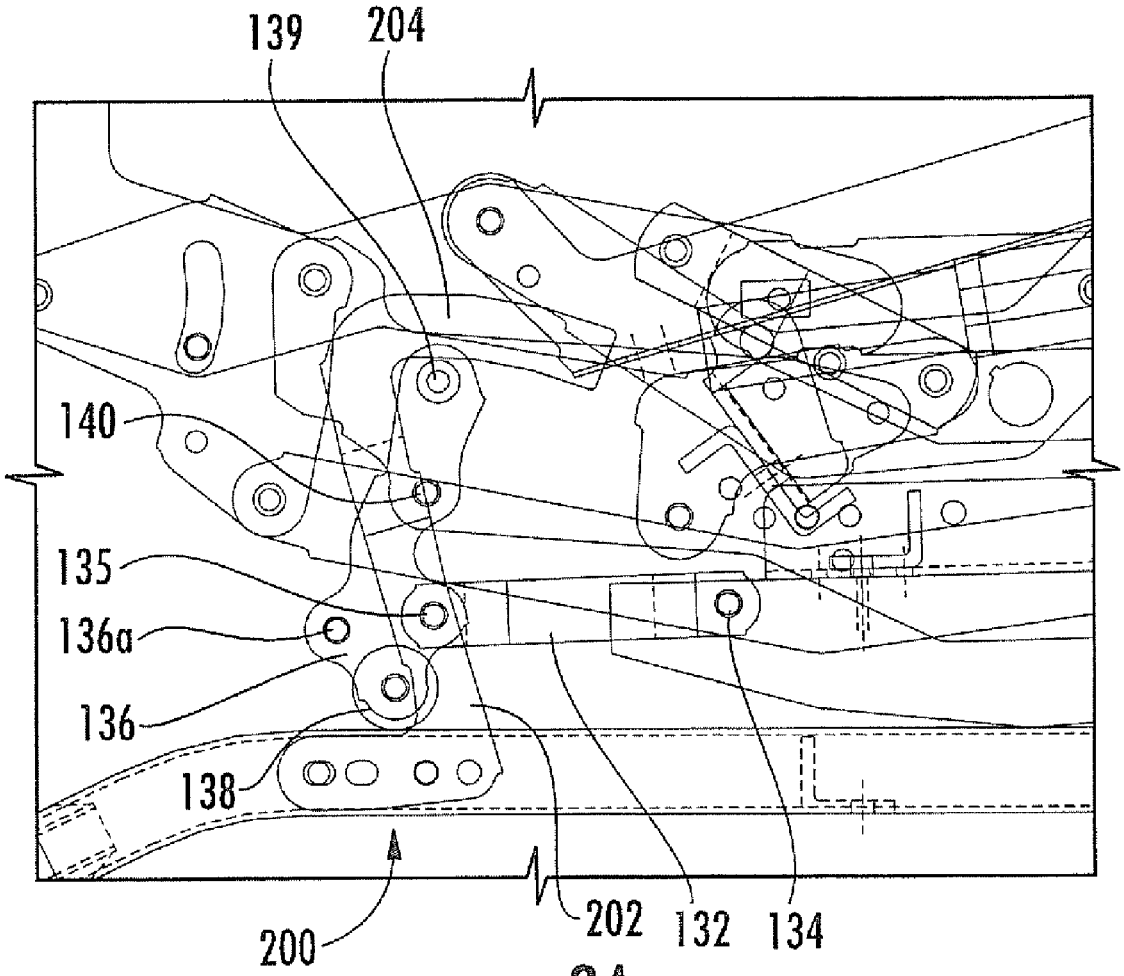
FIG. 3A is an enlarged view of the locking mechanism of the chair of FIG. 1 with the chair in its TV position.

In addition, the rotation of the lower ottoman swing link 76 draws the connecting link 100 forward (see FIGS. 2A and 3A). Movement of the connecting link 100 draws the lock drive link 132 forward, which in turn draws the locking link 136 counterclockwise around the pivot 140 to a generally vertical orientation. This action forces the wheel 138 on one free end of the locking link 136 downwardly into contact with the upper bearing surface of the rail 16, and drives the pin 139 on the other free end of the locking link 136 into the corner section 206 of the capture member 200. In this position, any attempt to rock the chair rearwardly is prevented by the wheel 138 bearing on the upper surface of the base unit 11, and any attempt to rock the chair forwardly is prevented by the pin 139 bearing on the capture member 200. The configuration of the locking mechanism 130 may be particularly desirable because it involves relatively few moving parts, thereby simplifying its manufacture and operation.

Further, the forward movement of the connecting link 100 induces the sequencer plate 54 to rotate counterclockwise about the pivot 58. This movement lowers the backpost 48 relative to the base 11, which increases the pitch of the seat 13.

To move the chair 10 from the TV position of FIG. 3 to the fully reclined position of FIG. 4, the occupant can continue to operate the actuator, which extends the rod 118 farther out of the sleeve 116. When the ottomans 17*a*, 17*b* are fully extended, the pivots 84, 88 and 94 are in a near "over-center" condition that helps to lock the ottomans 17*a*, 17*b* in an extended position. Thus, as the rod 118 continues to extend from the sleeve 116 when the chair is in the TV position, the motor unit 114 cannot move forward relative to the base unit 11 any farther, so the rear end of the rod 118 begins to move rearwardly relative to the base unit 11, resulting in counterclockwise rotation of the lower swing link 34 about the pivot 36. This rotation drives the upper swing link 38 clockwise about the pivot 50, which forces the forward end of the backpost 48 upward. As a consequence, the backpost 48 rotates counterclockwise about the pivot 58 relative to the sequencer plate 54 (and to the seat adapter 66, the seat frame 62 and the seat bracket 64). Rotation of the backpost 48 and, in turn, the backrest 15, continues until (a) the pin 48*b* on the backpost 48 reaches the upper end of the slot 54*a* in the sequencer plate 54 and (b) the pin 52*b* of the coupling link 52 reaches the rear end of the slot 32*a* of the mounting bracket 32. In this position, the backrest 15 has reclined relative to the seat 13 at a greater angle than in the upright and TV positions.

Figure 4A:
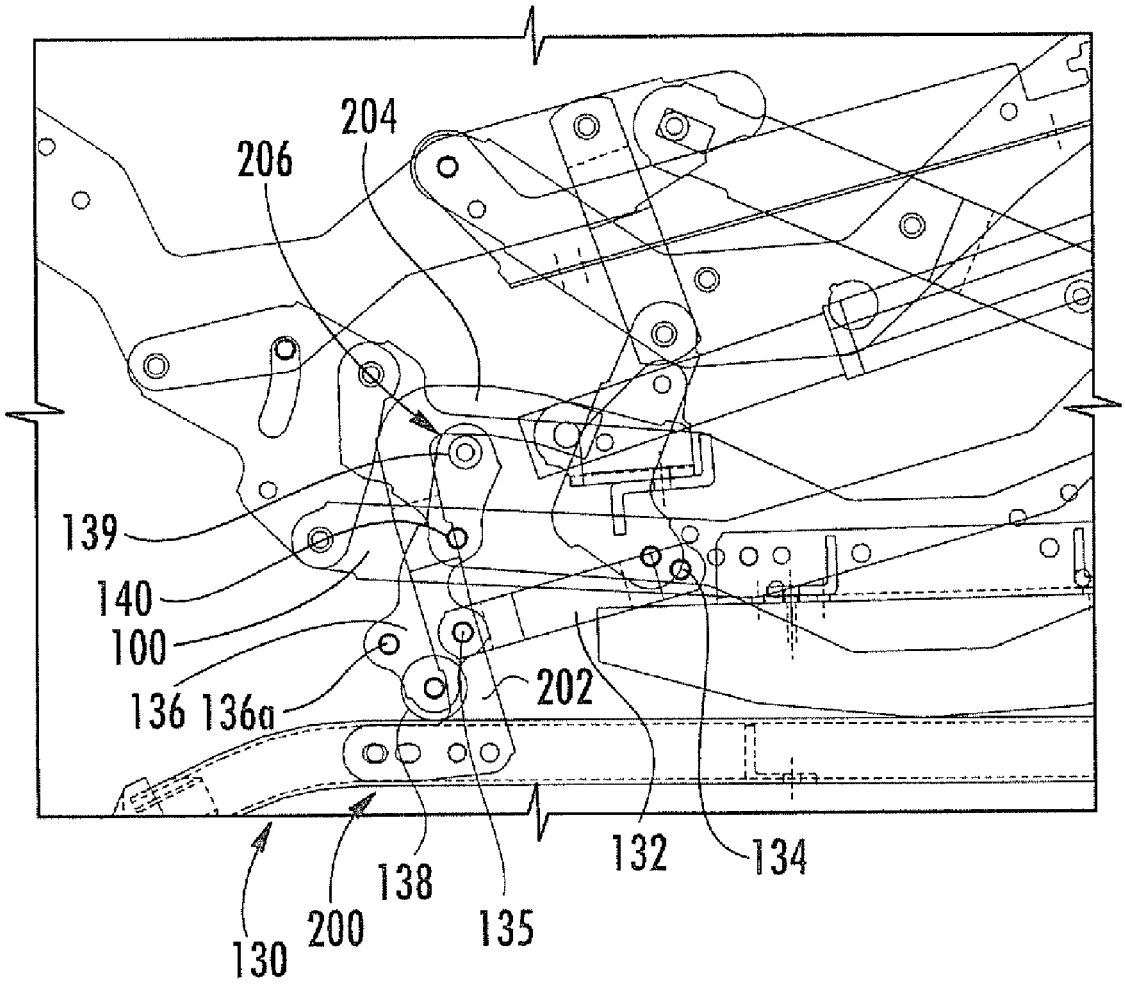
FIG. 4A is an enlarged view of the locking mechanism of the chair of FIG. 1 with the chair in its fully reclined position.

It can also be seen in FIG. 4A that the locking mechanism 130 continues to prevent the chair 10 from rocking as the chair 10 moves to the fully reclined position. It can also be seen that the seat 13, driven primarily by the lower swing link 34 and the coupling link 52, rises during movement from the TV position to the fully reclined position.

The chair 10 can be returned to its TV position from the fully reclined position by the occupant operating the actuator in the reverse direction. Because of the over-center condition of the pivots 82, 84, 88, the ottomans 17*a*, 17*b* remain extended, such that retraction of the rod 118 draws the backrest 15 to its upright position. Once the motion of the backrest 15 is complete, the over-center condition of the pivots 84, 88 and 94 can be overcome, and the ottomans 17*a*, 17*b* are able to retract to the upright position.

Those skilled in this art will recognize that other variations of the chair 10 are contemplated in connection with the present invention. For example, the power unit 112 may be reversed, such that the motor 114 is at the rear end of the power unit 112 and the rod 118 is at the front end. In such a case, the rod 118 would extend forwardly relative to the base unit 11 as the chair 10 moved from the upright position to the TV position, and the motor 114 would move rearwardly relative to the base unit 11 when the chair moved from the TV position to the fully reclined position. In either instance, the front end of the power unit 112 moves relative to the base unit 11 during the movement from the upright to the TV position, and the rear end of the power unit moves relative to the base unit 11 during the movement from the TV to the fully reclined position.

Also, in some embodiments the rocking mechanism 31 may be replaced with a gliding mechanism or the like that can impart a longitudinally-directed reciprocating movement of the seat relative to the base unit.

Further, the capture member 200 may take a different shape. For example, the capture member may define a closed loop, within which the pin 139 can move during rocking motion. The locking link 132 may also take a different configuration, or may be driven by a different link of the reclining mechanism 30. The wheel 138 may be omitted or replaced with a different contact member. Other alternatives may be apparent to those of skill in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A rocking and reclining seating unit, comprising:

a base unit;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

a longitudinally-directed reciprocating mechanism attached with the base unit and the reclining mechanism, the reciprocating mechanism configured to enable the seat, backrest and reclining mechanism to experience a longitudinally-directed reciprocating motion relative to the base unit; and a locking unit coupled to the reclining mechanism that allows the seating unit to reciprocate while in the upright position but prevents reciprocating of the seating unit while in the TV and fully reclined positions, the locking unit comprising:

a locking link pivotally attached with the reclining mechanism; and a capture member fixed to the base, the capture member having an upright segment extending upwardly from the base and a horizontal segment fixed to the upright segment, wherein a corner section is formed at the intersection of the upright and horizontal segments;

wherein the capture member and the locking link are configured such that the locking link resides in the corner section of the capture member when the seating unit is in the TV and fully reclined positions.

2. The seating unit defined in claim 1, wherein the reciprocating mechanism is a rocker mechanism with cams that rock relative to the base unit.

3. The seating unit defined in claim 1, wherein the horizontal segment extends forwardly from the upright segment.

4. The seating unit defined in claim 2, wherein the locking link is pivotally attached to a foundation plate fixed to the rocker cam.

5. The seating unit defined in claim 4, wherein the locking unit further comprises: a connecting link that couples the locking mechanism to the reclining mechanism; and a lock drive link that is pivotally connected to the connecting link and to the locking link.

6. The seating unit defined in claim 1, wherein the locking link engages the base unit in the TV and fully reclined positions.

7. The seating unit defined in claim 1, wherein the reclining mechanism includes a pantographic linkage on which the ottoman is mounted, and wherein in the TV and fully reclined positions, pivots between links of the pantographic linkage form a near over-center arrangement that locks the ottoman in position.

8. The seating unit defined in claim 1, wherein the seat rises in moving from the TV position to the fully reclined position.

9. The seating unit defined in claim 2, wherein the reclining mechanism includes a backpost that is fixed relative to the backrest, a mounting bracket that is fixed relative to the rocker cams and pivotally attached to the backpost, and a seat adapter that is fixed relative to the seat pivotally attached to the backpost.

10. The seating unit defined in claim 1, wherein the power actuating unit includes opposed first and second ends, and wherein the first end of the power actuating unit moves forwardly as the seating unit moves from the upright position to the TV position, and wherein the second end of the power actuating unit moves rearwardly when the seating unit moves from the TV position to the fully reclined position.

11. A rocking and reclining seating unit, comprising:

a base unit;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

a power actuating unit attached to the reclining mechanism;

a rocker mechanism attached with the base unit and the reclining mechanism, the rocker mechanism configured to enable the seat, backrest and reclining mechanism to experience a longitudinally-directed rocking motion relative to the base unit; and a locking unit coupled to the reclining mechanism that allows the seating unit to rock while in the upright position but prevents rocking of the seating unit while in the TV and fully reclined positions, the locking unit comprising:

a locking link pivotally attached with the reclining mechanism; and a capture member fixed to the base, the capture member having an upright segment extending upwardly from the base and a horizontal segment fixed to the upright segment, wherein a corner section is formed at the intersection of the upright and horizontal segments;

wherein the capture member and the locking link are configured such that the locking link resides in the corner section of the capture member when the seating unit is in the TV and fully reclined positions.

12. The seating unit defined in claim 11, wherein the power actuating unit includes opposed first and second ends, and wherein the first end of the power actuating unit moves forwardly as the seating unit moves from the upright position to the TV position, and wherein the second end of the power actuating unit moves rearwardly when the seating unit moves from the TV position to the fully reclined position.

13. The seating unit defined in claim 12, wherein the reclining mechanism includes a lower swing link pivotally attached with the base and an upper swing link pivotally attached with the lower swing link and with the backrest.

14. The seating unit defined in claim 12, wherein the power actuating unit includes a motor and an extendable member at the first and second ends.

15. The seating unit defined in claim 11, wherein the horizontal segment extends forwardly from the upright segment.

16. The seating unit defined in claim 11, wherein the locking link is pivotally attached to a foundation plate fixed to a rocker cam of the rocking mechanism.

17. The seating unit defined in claim 16, wherein the locking unit further comprises: a connecting link that couples the locking mechanism to the reclining mechanism; and a lock drive link that is pivotally connected to the connecting link and to the locking link.

18. The seating unit defined in claim 11, wherein the locking link engages the base unit in the TV and fully reclined positions.

19. A rocking and reclining seating unit, comprising:

a base unit;

a generally horizontally-disposed seat positioned above the base unit;

a generally upright backrest positioned above the base unit and substantially rearward of the seat;

an extendable ottoman;

a reclining mechanism attached to the seat, the backrest, the ottoman and the base unit, the reclining mechanism comprising a plurality of pivotally interconnected links, the reclining mechanism configured to move the seating unit between (a) an upright position, in which the seat is generally horizontally disposed, the backrest is generally vertically disposed, and the ottoman are generally vertically disposed and positioned below the seat, (b) an intermediate TV position, in which the ottoman is generally horizontally disposed in front of the seat and the backrest and the seat substantially maintain the same relationship as they have in the upright position, and (c) a fully reclined position, in which the angle between the backrest and the seat increases;

a longitudinally-directed reciprocating mechanism attached with the base unit and the reclining mechanism, the reciprocating mechanism configured to enable the seat, backrest and reclining mechanism to experience a longitudinally-directed reciprocating motion relative to the base unit; and a locking unit coupled to the reclining mechanism that allows the seating unit to reciprocate while in the upright position but prevents reciprocating of the seating unit while in the TV and fully reclined positions, the locking unit comprising:

a locking link pivotally attached with the reclining mechanism; and a capture member fixed to the base the capture member having an upright segment extending upwardly from the base and a horizontal segment fixed to the upright segment, wherein a corner section is formed at the intersection of the upright and horizontal segments;

wherein the locking link engages both the base and the capture member at the corner section when the seating unit is in the TV and fully reclined positions.

20. The seating unit defined in claim 19, wherein the locking link has opposed free ends, and wherein a first of the free ends engages the base and a second of the free ends engages the capture member when the seating unit is in the TV and fully reclined positions.

21. The seating unit defined in claim 19, wherein the locking link is generally horizontally disposed when the seating unit is in the upright position and is generally vertically disposed when the seating unit is in the TV and fully reclined positions.

* * * * *